US006811682B2

(12) United States Patent
Stuntz et al.

(10) Patent No.: US 6,811,682 B2
(45) Date of Patent: Nov. 2, 2004

(54) CYCLE OIL CONVERSION PROCESS

(75) Inventors: Gordon F. Stuntz, Baton Rouge, LA (US); George A. Swan, III, Baton Rouge, LA (US); William E. Winter, Pensacola, FL (US); Michel Daage, Baton Rouge, LA (US); Michele S. Touvelle, Centreville, VA (US); Darryl P. Klein, Ellicott City, MD (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 16 days.

(21) Appl. No.: 10/264,449

(22) Filed: Oct. 2, 2002

(65) Prior Publication Data

US 2003/0132137 A1 Jul. 17, 2003

Related U.S. Application Data

(63) Continuation-in-part of application No. 09/811,166, filed on Mar. 16, 2001, now abandoned.

(60) Provisional application No. 60/197,567, filed on Apr. 17, 2000.

(51) Int. Cl.[7] ..... C10G 51/02

(52) U.S. Cl. ..... 208/74; 208/67; 208/75; 208/76; 208/77

(58) Field of Search ..... 208/67, 68, 74, 208/75, 76, 77, 113

(56) References Cited

U.S. PATENT DOCUMENTS

| | | | | | |
|---|---|---|---|---|---|
| 2,890,164 | A | | 6/1959 | Woertz | 208/74 |
| 3,065,166 | A | | 11/1962 | Henning | 208/67 |
| 3,168,461 | A | * | 2/1965 | Russell et al. | 208/89 |
| 3,193,486 | A | * | 7/1965 | Payne | 208/50 |
| 3,479,279 | A | | 11/1969 | Poblenz | 208/56 |
| 3,489,673 | A | | 1/1970 | Stine et al. | 208/73 |
| 3,533,936 | A | | 10/1970 | Weisz | 208/56 |
| 3,536,609 | A | | 10/1970 | Stine et al. | 208/72 |
| 3,617,497 | A | | 11/1971 | Bryson et al. | 208/80 |
| 3,630,886 | A | | 12/1971 | Deed et al. | 208/96 |
| 3,692,667 | A | | 9/1972 | McKinney et al. | 208/120 |
| 3,761,391 | A | | 9/1973 | Conner | 208/76 |
| 3,803,024 | A | | 4/1974 | Haunschild | 208/76 |
| 3,886,060 | A | | 5/1975 | Owen | 208/120 |
| 3,893,905 | A | * | 7/1975 | Fenske et al. | 585/653 |
| 3,894,933 | A | | 7/1975 | Owen et al. | 208/77 |
| 3,928,172 | A | | 12/1975 | Davis, Jr. et al. | 208/77 |
| 3,948,757 | A | * | 4/1976 | Strother | 208/74 |
| 4,051,013 | A | | 9/1977 | Strother | 208/78 |
| 4,239,654 | A | | 12/1980 | Gladrow et al. | 252/455 Z |
| 4,259,175 | A | * | 3/1981 | McArthur | 208/113 |
| 4,267,072 | A | | 5/1981 | Vasalos | 252/455 |
| 4,388,175 | A | | 6/1983 | Lionetti et al. | 208/74 |
| 4,490,241 | A | | 12/1984 | Chou | 208/75 |
| 4,585,545 | A | | 4/1986 | Yancey, Jr. et al. | 28/74 |
| 4,750,988 | A | | 6/1988 | Mitchell et al. | 208/118 |
| 4,775,461 | A | | 10/1988 | Harris et al. | 208/120 |
| 4,780,193 | A | * | 10/1988 | Derr et al. | 208/89 |
| 4,794,095 | A | | 12/1988 | Walker et al. | 502/64 |
| 4,846,960 | A | | 7/1989 | Walker et al. | 208/119 |
| 4,897,643 | A | | 1/1990 | Shibata et al. | 208/70 |
| 4,968,405 | A | | 11/1990 | Wachter | 208/120 |
| 4,990,239 | A | * | 2/1991 | Derr et al. | 208/68 |
| 5,009,769 | A | * | 4/1991 | Goelzer | 208/113 |
| 5,043,522 | A | | 8/1991 | Leyshon et al. | 585/651 |
| 5,098,554 | A | | 3/1992 | Krishna et al. | 208/113 |
| 5,139,648 | A | | 8/1992 | Lambert | 208/111 |
| 5,152,883 | A | | 10/1992 | Melin et al. | 208/61 |
| 5,176,815 | A | | 1/1993 | Lomas | 208/78 |
| 5,243,121 | A | | 9/1993 | Madon et al. | 585/649 |
| 5,278,114 | A | | 1/1994 | Wielers et al. | 502/67 |
| 5,318,689 | A | | 6/1994 | Hsing et al. | 208/70 |
| 5,389,232 | A | | 2/1995 | Adewuyi et al. | 208/120 |
| 5,846,403 | A | | 12/1998 | Swan et al. | 208/113 |
| 5,944,982 | A | | 8/1999 | Lomas | 208/164 |

FOREIGN PATENT DOCUMENTS

| | | | |
|---|---|---|---|
| CA | 852713 | 9/1970 | |
| CA | 863912 | 2/1971 | |
| CA | 935110 | 10/1973 | |
| DE | 248516 | 8/1987 | B01J/29/04 |
| DE | 4114874 | 11/1991 | C10G/11/05 |
| EP | 0101553 | 2/1984 | C10G/11/18 |
| EP | 0369536 | 5/1990 | C10G/11/18 |
| EP | 0391528 | 10/1990 | C10G/69/04 |
| EP | 0825243 | 2/1998 | C10G/69/00 |
| EP | 0825244 | 2/1998 | C10G/69/00 |
| WO | WO90 15121 | 12/1990 | C10G/67/04 |

* cited by examiner

*Primary Examiner*—Walter D. Griffin
(74) *Attorney, Agent, or Firm*—Erika Singleton Wilson; Jeremy J. Kliebert

(57) ABSTRACT

The invention relates to a process for converting cycle oils produced in catalytic cracking reactions into light olefin and naphtha. More particularly, the invention relates to a process for hydroprocessing a catalytically cracked light cycle oil in order to form a hydroprocessed cycle oil containing a significant amount of tetralins. The hydroprocessed cycle oil is then re-cracked in an upstream zone of the primary FCC riser reactor.

9 Claims, No Drawings

CYCLE OIL CONVERSION PROCESS

CROSS-REFERENCE TO RELATED APPLICATIONS

This patent application is a continuation-in-part of U.S. Application No. 09/811,166 filed on Mar. 16, 2001, now abandoned, which claims benefit of U.S. provisional patent application 60/197,567 filed on Apr. 17, 2000.

FIELD OF THE INVENTION

The present invention relates to a process for converting cycle oils produced in catalytic cracking reactions into olefin and naphtha. More particularly, the invention relates to a process for converting a catalytically cracked cycle oil such as heavy cycle oil ("HCO" or "HCCO"), light cycle oil ("LCO" or "LCCO"), and mixtures thereof into olefins and naphthas using a zeolite catalyst.

BACKGROUND OF THE INVENTION

Cycle oils such as HCCO and LCCO produced in fluidized catalytic cracking ("FCC") reactions contain two-ring aromatic species such as naphthalene. The need for blendstocks for forming low emissions fuels has created an increased demand for FCC products that contain a diminished concentration of multi-ring aromatics. There is also an increased demand for FCC products containing light olefins that may be separated for use in alkylation, oligomerization, polymerization, and MTBE and ETBE synthesis processes. There is a particular need for low emissions, high octane FCC products having an increased concentration of $C_2$ to $C_4$ olefins and a reduced concentration of multi-ring aromatics and olefins of higher molecular weight.

A high octane gasoline may be formed conventionally by hydrotreating an FCC cycle oil and then re-cracking hydrotreated cycle oil. The hydrotreated cycle oil may be recycled to the FCC unit from which it was derived, or it may be re-cracked in an additional catalytic cracking unit.

In such conventional processes, hydrotreating a cycle oil such as LCCO partially saturates bicyclic aromatics such as naphthalene to produce, for example, tetrahydronaphthalene and alkyl-substituted derivatives thereof (collectively referred to herein as ("tetralins"). Hydrotreatment and subsequent cycle oil re-cracking may occur in the primary FCC reactor. Hydrotreated cycle oil may also be injected into the FCC feed riser upstream or downstream of primary feed injection. In another conventional process, hydrotreated cycle oil is recycled with a hydrotreated naphtha, and both are injected into the primary riser reactor at a point upstream of primary feed injection.

Unfortunately, such re-cracking of hydrotreated LCCO results in undesirable hydrogen transfer reactions that convert species such as tetralins into polynuclear aromatics such as naphthalene.

There remains a need, therefore, for new processes for forming naphtha and olefin from hydrotreated cycle oils.

SUMMARY OF THE INVENTION

In one embodiment, the invention is a method for catalytically cracking a primary feed comprising:

(a) injecting the primary feed into an FCC riser reactor having at least a first reaction zone and a second reaction zone upstream of the first reaction zone, the primary feed being injected into the first reaction zone;

(b) cracking the primary feed in the first reaction zone under primary feed catalytic cracking conditions in the presence of a catalytically effective amount of a zeolite-containing catalytic cracking catalyst in order to form a cracked product;

(c) separating at least a cycle oil from the cracked product and then processing the cycle oil in the presence of a catalytically effective amount of a hydroprocessing catalyst under hydroprocessing conditions in order to form a hydroprocessed cycle oil having an increased concentration of tetralins;

(d) injecting the hydroprocessed cycle oil into the second reaction zone; and (e) cracking the hydroprocessed cycle oil under cycle oil catalytic cracking conditions in the presence of the catalytic cracking catalyst.

In another embodiment, the invention is a cracked product formed in accordance with such a process.

DETAILED DESCRIPTION OF THE INVENTION

The invention is based on the discovery that recycling a hydrotreated cycle oil such as HCCO and LCCO to an FCC reaction zone in the presence of a catalytically effective amount of an appropriate FCC catalyst results in increased propylene production when the cycle oil injection is along the feed riser at a point upstream of gas oil or residual oil feed injection. It is believed that injecting the cycle oil into the FCC reaction zone in the presence of an appropriate FCC catalyst and at a point upstream of gas oil or residual oil injection suppresses undesirable hydrogen transfer reactions by re-cracking potential hydrogen donors present in the cycle oil before such donors can contact the primary feed.

Preferred hydrocarbonaceous feeds (i.e. the primary feed) for the catalytic cracking process described herein include naphtha, hydrocarbonaceous oils boiling in the range of about 430° F. (220° C.) to about 1050° F. (565° C.), such as gas oil; heavy hydrocarbonaceous oils comprising materials boiling above 1050° F. (565° C.); heavy and reduced petroleum crude oil; petroleum atmospheric distillation bottoms; petroleum vacuum distillation bottoms; pitch, asphalt, bitumen, other heavy hydrocarbon residues; tar sand oils; shale oil; liquid products derived from coal and natural gas, and mixtures thereof.

The preferred cracking process may be performed in one or more conventional FCC process units. Each unit comprises a riser reactor having a first reaction zone and a second reaction zone upstream of the first reaction zone, a stripping zone, a catalyst regeneration zone, and at least one separation zone.

The primary feed is conducted to the riser reactor where it is injected into the first reaction zone wherein the primary feed contacts a flowing source of hot, regenerated catalyst. The hot catalyst vaporizes and cracks the feed at a temperature from about 450° C. to 650° C., preferably from about 500° C. to 600° C. The cracking reaction deposits carbonaceous hydrocarbons, or coke, on the catalyst, thereby deactivating the catalyst. The cracked products may be separated from the coked catalyst and a portion of the cracked products may be conducted to a separator such as a fractionator. At least a cycle oil fraction, preferably an LCCO fraction, is separated from the cracked products in the separation zone. Other fractions that may be separated from the cracked products include light olefin fractions and naphtha fractions.

Light olefins separated from the process may be used as feeds for processes such as oligimerization, polymerization, co-polymerization, ter-polymerization, and related processes (hereinafter "polymerization") in order to form macromolecules. Such light olefins may be polymerized both alone and in combination with other species, in accordance with polymerization methods known in the art. In some cases it may be desirable to separate, concentrate, purify, upgrade, or otherwise process the light olefins prior to polymerization. Propylene and ethylene are preferred polymerization feeds. Polypropylene and polyethylene are preferred polymerization products made therefrom.

Preferably, the coked catalyst flows through the stripping zone where volatiles are stripped from the catalyst particles with a stripping material such as steam. The stripping may be preformed under low severity conditions in order to retain a greater fraction of adsorbed hydrocarbons for heat balance. The stripped catalyst is then conducted to the regeneration zone where it is regenerated by burning coke on the catalyst in the presence of an oxygen containing gas, preferably air. Decoking restores catalyst activity and simultaneously heats the catalyst to, e.g., 650° C. to 800° C. The hot catalyst is then recycled to the riser reactor at a point near or just upstream of the second reaction zone. Flue gas formed by burning coke in the regenerator may be treated for removal of particulates and for conversion of carbon monoxide, after which the flue gas is normally discharged into the atmosphere.

Preferably, at least a portion of the cycle oil is hydroprocessed in the presence of a hydroprocessing catalyst under hydroprocessing conditions in order to form a cycle oil having a significant amount of tetralins. At least a portion of the hydroprocessed cycle oil is conducted to the riser reactor and injected into the second reaction zone. The hydroprocessing may occur in one or more hydroprocessing reactors. It should be noted that such hydroprocessing conditions may also result in the formation of substantial amounts of other species such as indans and functionalized indans. The presence of such species is not detrimental to the practice of the invention.

Preferred process conditions in the riser reactor's first reaction zone include temperatures from about 450° C. to about 650° C., preferably from about 525° C. to 600° C., hydrocarbon partial pressures from about 10 to 40 psia, preferably from about 20 to 35 psia; and a catalyst to primary feed (wt/wt) ratio from about 3 to 12, preferably from about 4 to 10, where catalyst weight is total weight of the catalyst composite. Though not required, it is also preferred that steam be concurrently introduced with the primary feed into the reaction zone, with the steam comprising up to about 10 wt. %, preferably about 2 to about 3 wt. % of the primary feed. Also, it is preferred that the primary feed's residence time in the reaction zone be less than about 20 seconds, preferably from about 1 to 20 seconds, and more preferably from about 1 to about 6 seconds.

Preferred process conditions in the riser reactor's second reaction zone include temperatures from about 550° C. to about 700° C., preferably from about 525° C. to 650° C., hydrocarbon partial pressures from about 10 to 40 psia, preferably from about 20 to 35 psia; and a catalyst to cycle oil (wt/wt) ratio from about 5 to 100, preferably from about 10 to 100, where catalyst weight is total weight of the catalyst composite. Though not required, it is also preferred that steam be concurrently introduced with the cycle oil feed into the reaction zone, with the steam comprising up to about 10 wt. %, preferably 1 to 5 wt. % of the primary feed. Also, it is preferred that the cycle oil's residence time in the reaction zone be less than about 10 seconds, preferably from about 0.1 to about 10 seconds, and more preferably from about 0.1 seconds to about 1.0 seconds.

A preferred fluidized catalytic cracking catalyst ("FCC catalyst" herein) is a composition of catalyst particles and other reactive and non-reactive components. More than one type of catalyst particle may be present in the catalyst. A preferred FCC catalyst particle useful in the invention contains at least one crystalline aluminosilicate, also referred to as zeolite, of average pore diameter greater than about 0.7 nanometers (nm), i.e., large pore zeolite cracking catalyst. The pore diameter also sometimes referred to as effective pore diameter can be measured using standard adsorption techniques and hydrocarbons of known minimum kinetic diameters. See Breck, Zeolite Molecular Sieves, 1974 and Anderson et al., J. Catalysis 58, 114 (1979), both of which are incorporated herein by reference. Zeolites useful in the invention are described in the "Atlas of Zeolite Structure Types," eds. W. H. Meier and D. H. Olson, Butterworth-Heineman, Third Edition, 1992, which is hereby incorporated by reference. As discussed, the FCC catalyst may be in the form of particles containing zeolite. The catalyst may also include fines, inert particles, particles containing a metallic species, and mixtures thereof. Particles containing metallic species include platinum compounds, platinum metal, and mixtures thereof.

FCC catalyst particles may contain metals such as platinum, promoter species such as phosphorous-containing species, clay filler, and species for imparting additional catalytic functionality such as bottoms cracking and metals passivation. Such an additional catalytic functionality may be provided, for example, by aluminum-containing species. More than one type of catalyst particle may be present in the FCC catalyst. For example, individual catalyst particles may contain large pore zeolite, shape selective zeolite, and mixtures thereof.

The FCC catalyst particle may be bound together with an inorganic oxide matrix component. The inorganic oxide matrix component binds the particle's components together so that the FCC catalyst particle is hard enough to survive interparticle and reactor wall collisions. The inorganic oxide matrix may be made according to conventional methods from an inorganic oxide sol or gel which is dried to "glue" the catalyst particle's components together. Preferably, the inorganic oxide matrix is not catalytically active and comprises oxides of silicon and aluminum. It is also preferred that separate alumina phases be incorporated into the inorganic oxide matrix. Species of aluminum oxyhydroxides-γ-alumina, boehmite, diaspore, and transitional aluminas such as α-alumina, β-alumina, γ-alumina, δ-alumina, ϵ-alumina, κ-alumina, and ρ-alumina can be employed. Preferably, the alumina species is an aluminum trihydroxide such as gibbsite, bayerite, nordstrandite, or doyelite. The matrix material may also contain phosphorous or aluminum phosphate.

Preferred FCC catalyst particles in the present invention contain at least one of:

(a) amorphous solid acids, such as alumina, silica-alumina, silica-magnesia, silica-zirconia, silica-thoria, silica-beryllia, silica-titania, and the like; and (b) zeolite catalysts containing faujasite.

Silica-alumina materials suitable for use in the present invention are amorphous materials containing about 10 to 40 wt. % alumina and to which other promoters may or may not be added.

Suitable zeolite in such catalyst particles include zeolites which are iso-structural to zeolite Y. These include the ion-exchanged forms such as the rare-earth hydrogen and ultra stable (USY) form. The zeolite may range in size from about 0.1 to 10 microns, preferably from about 0.3 to 3 microns. The zeolite will be mixed with a suitable porous matrix material in order to form the fluid catalytic cracking catalyst. Non-limiting porous matrix materials which may be used in the practice of the present invention include alumina, silica-alumina, silica-magnesia, silica-zirconia, silica-thoria, silica-beryllia, silica-titania, as well as ternary compositions, such as silica-alumina-thoria, silica-alumina-zirconia, magnesia and silica-magnesia-zirconia. The matrix may also be in the form of a cogel. The relative proportions of zeolite component and inorganic oxide gel matrix on an anhydrous basis may vary widely with the zeolite content, ranging from about 10 to 99, more usually from about 10 to 80, percent by weight of the dry composite. The matrix itself may possess catalytic properties, generally of an acidic nature.

The amount of zeolite component in the catalyst particle will generally range from about 1 to about 60 wt. %, preferably from about 1 to about 40 wt. %, and more preferably from about 5 to about 40 wt. %, based on the total weight of the catalyst. Generally, the catalyst particle size will range from about 10 to 300 microns in diameter, with an average particle diameter of about 60 microns. The surface area of the matrix material will be less than or equal to about 350 $m^2/g$, preferably 50 to 200 $m^2/g$, more preferably from about 50 to 100 $m^2/g$. While the surface area of the final catalysts will be dependent on such things as type and amount of zeolite material used, it will usually be less than about 500 $m^2/g$, preferably from about 50 to 300 $m^2/g$, more preferably from about 50 to 250 $m^2/g$, and most preferably from about 100 to 250 $m^2/g$.

Another preferred FCC catalyst contains a mixture of zeolite Y and zeolite beta. The Y and beta zeolite may be on the same catalyst particle, on different particles, or some combination thereof. Such catalysts are described in U.S. Pat. No. 5,314,612, incorporated by reference herein. Such catalyst particles consist of a combination of zeolite Y and zeolite beta combined in a matrix comprised of silica, silica-alumina, alumina, or any other suitable matrix material for such catalyst particles. The zeolite portion of the resulting composite catalyst particle will consist of 25 to 95 wt. % zeolite Y with the balance being zeolite beta.

Yet another preferred FCC catalyst contains a mixture of zeolite Y and a shape selective zeolite species such as ZSM-5 or a mixture of an amorphous acidic material and ZSM-5. The Y zeolite (or alternatively the amorphous acidic material) and shape selective zeolite may be on the same catalyst particle, on different particles, or some combination thereof. Such catalysts are described in U.S. Pat. No. 5,318,692, incorporated by reference herein. The zeolite portion of the catalyst particle will typically contain from about 5 wt. % to 95 wt. % zeolite-Y (or alternatively the amorphous acidic material) and the balance of the zeolite portion being ZSM-5.

Shape selective zeolite species useful in the preferred FCC catalyst include medium pore size zeolites generally having a pore size from about 0.5 nm, to about 0.7 nm. Such zeolites include, for example, MFI, MFS, MEL, MTW, EUO, MTT, HEU, FER, and TON structure type zeolites (IUPAC Commission of Zeolite Nomenclature). Non-limiting examples of such medium pore size zeolites, include ZSM-5, ZSM-12, ZSM-22, ZSM-23, ZSM-34, ZSM-35, ZSM-38, ZSM-48, ZSM-50, silicalite, and silicalite 2. The most preferred is ZSM-5, which is described in U.S. Pat. Nos. 3,702,886 and 3,770,614. ZSM-11 is described in U.S. Pat. No. 3,709,979; ZSM-12 in U.S. Pat. No. 3,832,449; ZSM-21 and ZSM-38 in U.S. Pat. No. 3,948,758; ZSM-23 in U.S. Pat. No. 4,076,842; and ZSM-35 in U.S. Pat. No. 4,016,245. All of the above patents are incorporated herein by reference.

Other preferred medium pore size zeolites include the silicoaluminophosphates (SAPO), such as SAPO-4 and SAPO-11 which is described in U.S. Pat. No. 4,440,871; chromosilicates; gallium silicates; iron silicates; aluminum phosphates (ALPO), such as ALPO-11 described in U.S. Pat. No. 4,310,440; titanium aluminosilicates (TASO), such as TASO-45 described in EP-A No. 229,295; boron silicates, described in U.S. Pat. No. 4,254,297; titanium aluminophosphates (TAPO), such as TAPO-11 described in U.S. Pat. No. 4,500,651; and iron aluminosilicates.

The large pore and shape selective zeolites in the catalytic species can include "crystalline admixtures" which are thought to be the result of faults occurring within the crystal or crystalline area during the synthesis of the zeolites. Examples of crystalline admixtures of ZSM-5 and ZSM-11 are disclosed in U.S. Pat. No. 4,229,424 which is incorporated herein by reference. The crystalline admixtures are themselves medium pore, i.e., shape selective, size zeolites and are not to be confused with physical admixtures of zeolites in which distinct crystals of crystallites of different zeolites are physically present in the same catalyst composite or hydrothermal reaction mixtures.

As set forth above, the process of the invention comprises cracking a primary feed in the first reaction zone of a riser reactor in order to form a cracked product. At least a portion of the cycle oil is separated from the cracked product and then hydroprocessed prior to injection into an FCC reaction zone. The hydroprocessed cycle oil is conducted to the riser reactor for injection into the second reaction zone upstream of the first (i.e., primary) injection zone. Preferably, the cycle oil hydroprocessing occurs in a hydroprocessing reactor under hydroprocessing conditions in the presence of a hydroprocessing catalyst in order to form a cycle oil having significant amounts of tetralins and indans. By significant tetralins and indans, we mean that the hydroprocessed cycle oil will contain at least about 20 wt. %, preferably at least about 30 wt. %, most preferably at least about 50 wt. % tetralins and indans, based on the total weight of the hydroprocessed cycle oil stream. Prior to hydroprocessing, the cycle oil will have a concentration of tetralins and indans of less than about 10 wt. %.

The term "hydroprocessing" is used broadly herein, and includes, for example, hydrogenation such as aromatics saturation, hydrotreating, hydrofining, and hydrocracking. As is known by those of skill in the art, the degree of hydroprocessing can be controlled through proper selection of catalyst as well as by optimizing operation conditions. It is desirable that the hydroprocessing convert a significant amount of aromatic species such as naphthalenes into tetralins using a catalytically effective amount of a hydrogenation catalyst. Objectionable species can also be removed by the hydroprocessing reactions. These species include species that may contain sulfur, nitrogen, oxygen, halides, and certain metals.

Cycle oil hydroprocessing may be performed under hydroprocessing conditions that result in conversion of multi-ring aromatic species (e.g., naphthalene) to the corresponding one-ring aromatic species (e.g., tetrahydronaphthalene). Hydroprocessing conditions can be effectively chosen to minimize conversion of multi-ring aromatic species to their fully saturated analogs (e.g. decahydronaphthalenes) in order to reduce hydrogen consumption in the hydroprocessing reactor. Preferably, the reaction is performed at a temperature ranging from about 200° C. to about 500° C., more preferably from about 250° C. to about 400° C. The reaction pressure preferably ranges from about 100 to about 2500 psig, more preferably from about 450 to about 1500 psig. The space velocity preferably ranges from about 0.1 to 6 V/V/Hr, more preferably from about 0.5 to about 2 V/V/Hr, where V/V/Hr is defined as the volume of oil per hour per volume of catalyst. The hydrogen containing gas is preferably added to establish a hydrogen charge rate ranging from about 500 to about 10,000 standard cubic feet per barrel (SCF/B), more preferably from about 500 to about 7,000 SCF/B. Actual conditions employed will depend on factors such as feed quality and catalyst, but should be consistent with the objective of maximizing conversion of multi-ring aromatic species to tetralins.

Accordingly, when cycle oil hydroprocessing is conducted under conditions that convert polynuclear aromatic species such as naphthalene into significant amounts of tetralins, catalytically cracking the hydrotreated cycle oil in accordance with this invention results in augmented cycle oil conversion to naphtha and light (i.e., $C_2$ to $C_5$) olefin. This beneficial conversion occurs, it is believed, because undesirable hydrogen transfer reactions are suppressed compared to conventional FCC cycle oil recycle processes.

In one example of such a conventional process, where a hydrotreated naphtha and a hydrotreated cycle oil are recycled to the primary FCC reactor, hydrogen transfers from tetralins present in the hydrotreated cycle oil to the olefin present in the hydrotreated naphtha before catalytic cracking can occur. Such hydrogen transfer reactions diminish the concentration of light olefin in the cracked product because olefin in the naphtha fraction is saturated and because species such as tetralin are converted into polynuclear aromatics instead of being cracked into light olefin and more desirable mononuclear aromatic species.

In other conventional processes, hydrotreated cycle oil is recycled to the primary FCC reactor without a hydrotreated naphtha fraction. Hydrogen transfer reactions prevent cycle oil conversion to naphtha and light olefin in these reactions because olefin present in the gas oil/resid feeds are effective hydrogen receptors for converting tetralins to naphthalene. Moreover, conventional amorphous cat cracking catalysts have a low activity for cracking tetralins into species such as xylene and light olefin. When the rate of hydrogen transfer from the tetralins to the light olefin exceeds the cracking rate, the tetralins will be preferentially converted to naphthalene, i.e., an undesirable, toxic, stable polynuclear aromatic species.

It is believed that these undesirable hydrogen transfer reactions are avoided in the present invention by recycling the hydrotreated cycle oil to a region of the primary riser reactor that is substantially free of a hydrogen receptor species naturally present in naphtha, gas oils, and resids. Moreover, the preferred catalysts of this invention contain a zeolite species, and consequently are far more active in cracking tetralins into species such as xylene and light olefin than are the amorphous catalytic cracking catalysts used in conventional cycle oil re-cracking. Consequently, the cracking of species such as tetralins into mononuclear aromatic species and light olefin is believed to proceed at a much higher rate that olefin hydrogenation in the practice of the present invention.

Preferred hydroprocessing conditions can be maintained by use of any of several types of hydroprocessing reactors. Trickle bed reactors are most commonly employed in petroleum refining applications with co-current downflow of liquid and gas phases over a fixed bed of catalyst particles. It can be advantageous to utilize alternative reactor technologies. Countercurrent-flow reactors, in which the liquid phase passes down through a fixed bed of catalyst against upward-moving treat gas, can be employed to obtain higher reaction rates and to alleviate aromatics hydrogenation equilibrium limitations inherent in co-current flow trickle bed reactors. Moving bed reactors can be employed to increase tolerance for metals and particulates in the hydroprocessor feed stream. Moving bed reactor types generally include reactors wherein a captive bed of catalyst particles is contacted by upward-flowing liquid and treat gas. The catalyst bed can be slightly expanded by the upward flow or substantially expanded or fluidized by increasing flow rate, for example, via liquid recirculation (expanded bed or ebullating bed), use of smaller size catalyst particles which are more easily fluidized (slurry bed), or both. In any case, catalyst can be removed from a moving bed reactor during onstream operation, enabling economic application when high levels of metals in feed would otherwise lead to short run lengths in the alternative fixed bed designs. Furthermore, expanded or slurry bed reactors with upward-flowing liquid and gas phases would enable economic operation with feedstocks containing significant levels of particulate solids, by permitting long run lengths without risk of shutdown due to fouling. Use of such a reactor would be especially beneficial in cases where the feedstocks include solids in excess of about 25 micron size, or contain contaminants which increase the propensity for foulant accumulation, such as olefinic or diolefinic species or oxygenated species. Moving bed reactors utilizing downward-flowing liquid and gas can also be applied, as they would enable on-stream catalyst replacement.

The catalyst used in the hydroprocessing stages should be a hydroprocessing catalyst suitable for aromatic saturation, desulfurization, denitrogenation or any combination thereof. Preferably, the catalyst is comprised of at least one Group VIII metal and a Group VI metal on an inorganic refractory support, which is preferably alumina or alumina-silica. The Group VIII and Group VI compounds are well known to those of ordinary skill in the art and are well defined in the Periodic Table of the Elements. For example, these compounds are listed in the Periodic Table found at the last page of Advanced Inorganic Chemistry, 2nd Edition 1966, Interscience Publishers, by Cotton and Wilkenson. The Group VIII metal is preferably present in an amount ranging from 2–20 wt. %, preferably 4–12 wt. %. Preferred Group VIII metals include Co, Ni, and Fe, with Co and Ni being most preferred. The preferred Group VI metal is Mo which is present in an amount ranging from 5–50 wt. %, preferably 10–40 wt. %, and more preferably from 20–30 wt. %.

All metals weight percents given are on support. The term "on support" means that the percents are based on the weight of the support. For example, if a support weighs 100 g, then 20 wt. % Group VIII metal means that 20 g of the Group VIII metal is on the support.

Any suitable inorganic oxide support material may be used for the hydroprocessing catalyst of the present invention. Preferred are alumina and silica-alumina, including crystalline alumino-silicate such as zeolite. More preferred is alumina. The silica content of the silica-alumina support can be from 2–30 wt. %, preferably 3–20 wt. %, more preferably 5–19 wt. %. Other refractory inorganic compounds may also be used, non-limiting examples of which include zirconia, titania, magnesia, and the like. The alumina can be any of the aluminas conventionally used for hydroprocessing catalysts. Such aluminas are generally porous amorphous alumina having an average pore size from 50–200 A, preferably, 70–150 A, and a surface area from 50–450 $m^2/g$.

Following cycle oil hydroprocessing, the hydroprocessed cycle oil is conducted to the riser reactor for injection into the second reaction zone. Accordingly, the cycle oil is cracked into lower molecular weight cracked products such as light olefin and undesirable hydrogen transfer reactions are suppressed. In addition to cycle oil, cracked products formed in the riser reactor include naphtha in amounts ranging from about 5 wt. % to about 50 wt. %, butanes in amounts ranging from about 2 wt. % to about 15 wt. %, butenes in amounts ranging from about 4 wt. % to about 11 wt. %, propane in amounts ranging from about 0.5 wt. % to about 3.5 wt. %, and propylene in amounts ranging from about 5 wt. % to about 20 wt. %. All wt. % are based on the total weight of the cracked product. In a preferred embodiment, at least 90 wt. % of the cracked products have boiling points less than 430° F. While not wishing to be bound by any theory, it is believed that the substantial concentration of propylene in the cracked product results from the hydroprocessed cycle oil cracking in the second reaction zone.

As used herein, cycle oil includes heavy cycle oil, light cycle oil, and mixtures thereof. Heavy cycle oil refers to a hydrocarbon stream boiling in the range of 240° C. to 370° C. (about 465° F. to about 700° F.). Light cycle oil refers to a hydrocarbon stream boiling in the range of 190° C. to 240° C. (about 375° F. to about 465° F.). Naphtha includes light cat naphtha and refers to a hydrocarbon stream having a final boiling point less than about 190° C. (375° F.) and containing olefins in the $C_5$ to $C_9$ range, single ring aromatics ($C_6$–$C_9$) and paraffins in the $C_5$ to $C_9$ range.

EXAMPLES

Example 1

A calculated comparison of cycle oil injection for re-cracking in an FCC reaction zone is set forth in Table 1. R.O.T. represents the riser outlet temperature, and the cat to oil ratio is on a total feed basis.

Simulations 1, 2, and 3 are compared to a "base case" FCC process with no cycle oil recycle. In case 1, cycle oil is separated from the FCC products and recycled to the FCC process via injection with the primary feed. In case 2, recycled cycle oil is injected upstream of primary feed injection. In case 3, the cycle oil is injected upstream of primary feed injection, as in case 2, and the cycle oil is hydrotreated under conditions to produce significant amounts of tetralins (Table 2). The hydrotreatment resulted in improved olefin yield compared to the base case and cases 1 and 2. Moreover, cycle oil conversion increased, and coke-make decreased. In all cases, a conventional large pore zeolite catalytic cracking catalyst was present in the reaction zone. No shape selective zeolite was employed.

TABLE 1

R.O.T. = 977° F. (525° C.), Cat/Oil = 6.6 (TF basis), 26 kB/D FF Rate

| CASE | BASE | 1 | 2 | 3 |
|---|---|---|---|---|
| HCO Recycle, kB/D | 0 | 2.3 | 2.3 | 2.3 |
| Injection Location | | Main Fd. | Pre-Inj. | Pre-Inj. |
| Preheat | | None | None | H/T |
| Yields, Wt. % FF | | | | |
| $C_2$– Dry Gas | 2.93 | 2.99 | 3.18 | 3.2 |
| $C_3$= | 3.94 | 3.99 | 4.09 | 4.09 |
| $C_4$= | 5.41 | 5.53 | 5.67 | 5.72 |
| LPG | 13.46 | 13.8 | 14.06 | 14.2 |

TABLE 1-continued

R.O.T. = 977° F. (525° C.), Cat/Oil = 6.6 (TF basis), 26 kB/D FF Rate

| CASE | BASE | 1 | 2 | 3 |
|---|---|---|---|---|
| Naphtha | 46.39 | 48.33 | 45.5 | 45.85 |
| LCO | 5.93 | 5.86 | 6.94 | 7.02 |
| HCO | 16.39 | 13.59 | 13.3 | 12.91 |
| Bottoms | 9.37 | 9.32 | 11.18 | 11.08 |
| Coke | 4.83 | 5.41 | 5.11 | 5.07 |
| 430° F. Conv. | 72 | 74.7 | 72.2 | 73.2 |
| % HCO Converted | 0 | 31 | 34 | 38 |

In accordance with a preferred embodiment, this example describes hydroprocessing a cycle oil stream and then injecting it at a point in a FCC riser reactor below (upstream of) the normal VGO feed injectors (i.e., a pre-injection zone). This provides a high temperature, high cat/oil, short residence time region wherein the hydrotreated cycle oil may be converted to naphtha and light olefins. Catalytic cracking conditions in the second reaction zone include temperatures ranging from about 1000–1350° F. (538–732° C.), cat/oil ratios of 25–150 (wt/wt), and vapor residence times of 0.1–1.0 seconds in the pre-injection zone. Conventional catalytic cracking conditions were used in the first reaction zone, with temperature ranging from about 950° F. (510° C.) to about 1050° F. (566° C.) and the cat:oil ratio ranging from about 4 to about 10.

In this example, the cycle oil was hydrogenated under the conditions set forth in Table 2, prior to upstream injection into an FCC riser reactor's upstream injection zone. The hydrotreatment resulted in a combined concentration of tetralins and indans of 32.6 wt. % compared to a concentration of less than 10 wt. % in the cycle oil before hydroprocessing.

TABLE 2

| | H/T LCCO |
|---|---|
| Conditions | |
| Catalyst | $NiMo/Al_2O_3$ |
| Temperature ° F./° C. | 700/371 |
| Pressure (psig) | 1200 |
| LHSV | 0.7 |
| $H_2$ Treat Gas Rate (SCF/B) | 5500 |
| Product Properties | |
| Boiling Point Distribution | |
| 0.5 wt. % ° F./° C. | 224.6/107 |
| 50.0 wt. % ° F./° C. | 513.4/267 |
| 99.5 wt. % ° F./° C. | 720.4/382 |
| Gravity (°API) | 26.2 |
| Total Aromatics (wt. %) | 57.6 |
| One-Ring Aromatics (wt. %) | 43.1 |
| Feedstock Properties | |
| Boiling Point Distribution | |
| 0.5 wt.% ° F./° C. | 299.8/149 |
| 50.0 wt.% ° F./° C. | 564.9/296 |
| 99.5 wt.% ° F./° C. | 727.8/387 |
| Gravity (°API) | 13.8 |
| Total Aromatics (wt. %) | 83.5 |
| One-Ring Aromatics (wt. %) | 9.7 |

A Microactivity Test Unit ("MAT") using a large pore zeolite cracking catalyst was employed for cracking the hydroprocessed cycle oil. Cracking conditions are set forth in Table 3.

MAT tests and associated hardware are described in Oil and Gas 64, 7, 84, 85, 1966, and Oil and Gas, Nov. 22, 1971, 60–68. Conditions used herein included temperature 550° C., run time 0.5 sec., catalyst charge 4.0 g, feed volume 0.95–1.0 $cm^3$, and cat:oil ratio 4.0–4.2.

Catalyst A is a commercially available, conventional, large pore FCC catalysts containing Y-zeolite. As can be seen in the table, significant conversion to propylene can be achieved by cracking hydrotreated cycle oil over the FCC catalyst.

TABLE 3

| Feedstock | H/T LCCO |
|---|---|
| Catalyst (steamed) | A |
| Temp., ° F./° C. | 1020/550 |
| Cat Oil | 3.96 |
| Conversion | 81.2 |
| Yields, Wt. % | |
| $C_2$- Dry Gas | 3.5 |
| Propylene | 5.4 |
| Propane | 1.9 |
| Butenes | 4.2 |
| Butanes | 8.8 |
| Naphtha | 53.2 |
| 430° F.+ | 18.8 |
| Coke | 4.3 |

The 81.2 total conversion, 9.6 wt. % light olefin yield, and the 18.8 wt. % yield of products boiling above 430° F., all compare favorably with conventional processes.

For example, in U.S. Pat. No. 3,479,279, a hydrotreated cycle oil containing a significant amount of tetralins (J=8) is recycled to the primary FCC unit and injected into a common cracking zone with the primary feed. The resulting FCC product contained 45 volume percent aromatics with the most numerous aromatic species being naphthalenes (J=12). This abundance of naphthalene strongly suggests the prevalence of undesirable hydrogen transfer reactions in addition to cracking.

In U.S. Pat. No. 3,065,166, a cycle oil is hydrotreated under conditions sufficient to result in partial saturation of the aromatic species, i.e., species such as naphthalenes are converted to species such as tetralins. The hydrotreated cycle oil is then injected into an upstream reaction zone of the primary FCC rector together with a hydrotreated naphtha. That the same amount of cycle oil is present in the cracked products independent of whether the recycled cycle oil is hydroprocessed, strongly suggests the prevalence of undesirable hydrogen transfer reactions resulting in the conversion of species such as tetralins into the more difficult to crack polynuclear aromatic species such as naphthalene.

What is claimed is:

1. A method for catalytically cracking a primary feed comprising the continuous steps of:

(a) injecting the primary feed into an FCC riser reactor having at least a first reaction zone and a second reaction zone upstream of the first reaction zone, the primary feed being injected into the first reaction zone;

(b) cracking the primary feed in the first reaction zone under catalytic cracking conditions in the presence of a catalytically effective amount of a regenerated, zeolite-containing, catalytic cracking catalyst in order to form at least partially spent catalyst and a cracked product;

(c) separating at least a cycle oil from the cracked product, which cycle oil has a concentration of tetralins and indans of less than about 10 wt. %, and then hydroprocessing at least a portion of the cycle oil in the presence of a catalytically effective amount of a hydroprocessing catalyst under hydroprocessing conditions in order to form a hydroprocessed cycle oil having a concentration of tetralins and indans of at least about 20 wt. %;

(d) injecting the hydroprocessed cycle oil into the second reaction zone; and (e) cracking the hydroprocessed cycle oil under cycle oil catalytic cracking conditions in the presence of the catalytic cracking catalyst.

2. The method of claim 1 wherein the primary feed is at least one of hydrocarbonaceous oils boiling in the range of about 220° C. to about 565° C.; naphtha; gas oil; heavy hydrocarbonaceous oils boiling above 565° C.; heavy and reduced petroleum crude oil; petroleum atmospheric distillation bottoms; petroleum vacuum distillation bottoms; pitch; asphalt; bitumen; tar sand oils; shale oil; and liquid products derived from coal and natural gas.

3. The method of claim 1 wherein conditions in the first reaction zone include temperatures from about 450° C. to about 650° C., hydrocarbon partial pressures from about 10 to 40 psia, a primary feed residence time of less than about 20 seconds, and a catalyst to primary feed (wt/wt) ratio from about 3 to 12, where catalyst weight is total weight of the cracking catalyst.

4. The method of claim 3 wherein steam is concurrently introduced with the primary feed into the first reaction zone.

5. The method of claim 1 wherein conditions in the riser reactor's second reaction zone include temperatures from about 550° C. to about 700° C., hydrocarbon partial pressures from about 10 to 40 psia, a cycle oil residence time of less than about 10 seconds, and a catalyst to cycle oil (wt/wt) ratio from about 5 to 100, where catalyst weight is total weight of the cracking catalyst.

6. The method of claim 5 wherein steam is concurrently introduced with the cycle oil feed into the second reaction zone.

7. The method of claim 1 wherein the hydroprocessing is performed at a temperature ranging from about 200° C. to about 500° C., a pressure ranging from about 100 to about 2500 psig, a space velocity ranging from about 0.1 to 6 V/V/Hr, and at a hydrogen charge rate ranging from about 500 to about 10,000 standard cubic feet per barrel (SCF/B).

8. The method of claim 1 further comprising conducting the partially spent catalyst to a stripping zone and removing strippable hydrocarbons in order to form stripped, spent catalyst, and then conducting the stripped spent catalyst to a regeneration zone for regenerating the spent catalyst under FCC catalyst regeneration conditions in order to form the regenerated, zeolite-containing, catalytic cracking catalyst.

9. The method of claim 8 further comprising separating propylene from the cracked product and then polymerizing the propylene in order to form polypropylene.

* * * * *